US006848969B2

(12) United States Patent
Luderich

(10) Patent No.: US 6,848,969 B2
(45) Date of Patent: Feb. 1, 2005

(54) METHOD AND DEVICE FOR TREATING SPECTACLE GLASSES BY MEANS OF A CNC-CONTROLLED SPECTACLE GLASS TREATMENT MACHINE

(75) Inventor: Joerg Luderich, Ratingen (DE)

(73) Assignee: Wernicke & Co. GmbH (DE)

( * ) Notice: Subject to any disclaimer, the term of this patent is extended or adjusted under 35 U.S.C. 154(b) by 8 days.

(21) Appl. No.: 09/979,380

(22) PCT Filed: Mar. 10, 2001

(86) PCT No.: PCT/EP01/02709

§ 371 (c)(1),
(2), (4) Date: Jun. 19, 2002

(87) PCT Pub. No.: WO01/70459

PCT Pub. Date: Sep. 27, 2001

(65) Prior Publication Data

US 2002/0155787 A1 Oct. 24, 2002

(30) Foreign Application Priority Data

Mar. 18, 2000 (DE) ..... 100 13 650

(51) Int. Cl.[7] ..... B24B 9/14

(52) U.S. Cl. ..... 451/5; 451/43; 451/10; 451/256

(58) Field of Search ..... 451/5, 41, 43, 451/10, 255, 256

(56) References Cited

U.S. PATENT DOCUMENTS 4,096,684 A * 6/1978 Akaba et al. ..... 451/240
5,727,987 A * 3/1998 Gottschlad ..... 451/5
6,045,432 A * 4/2000 Shibata ..... 451/5
6,050,877 A * 4/2000 Shibata et al. ..... 451/5
6,059,635 A * 5/2000 Mizuno ..... 451/5

FOREIGN PATENT DOCUMENTS

| | | |
|---|---|---|
| DE | 19527222 | 1/1997 |
| DE | 19804489 | 5/2000 |
| WO | WO 9939870 | 8/1999 |

OTHER PUBLICATIONS

International Search Report dated Aug. 21, 2001 in German and English.

Abstract of Japanese Patent No. JP 11 198013 dated Jul. 27, 1999.

German Patent Office Document dated Nov. 24, 2000.

Abstract of Japanese Patent No. JP 60 259365 dated Dec. 21, 1985.

* cited by examiner

*Primary Examiner*—Lee D. Wilson
(74) *Attorney, Agent, or Firm*—Ostrolenk, Faber, Gerb & Soffen, LLP

(57) ABSTRACT

A process of machining spectacle lenses using of a CNC spectacle lens-machining machine is provided. The process includes positioning the rough-cast lens on a holder in the spectacle lens-machining machine, machining an optical surface and/or the edge of the rough-cast lens in accordance with predetermined optical and/or shape-related values, continuously or cyclically checking the position of the rough-cast lens on the holder during machining using a sensor, and continuously or cyclically incorporating any recorded displacement of the rough-cast lens on the holder in the spectacle lens-machining values.

12 Claims, 3 Drawing Sheets

METHOD AND DEVICE FOR TREATING SPECTACLE GLASSES BY MEANS OF A CNC-CONTROLLED SPECTACLE GLASS TREATMENT MACHINE

BACKGROUND OF THE INVENTION

The invention relates to a process for machining spectacle lenses by means of a CNC spectacle lens-machining machine.

A process for taking into account, by calculation, the position of a rough-cast lens which has been positioned on a holding head of a rotatable shaft of a CNC installation for grinding spectacle lenses in accordance with a predeterminable contour of the spectacle lens in question, comprising the following steps: measuring the position of the rough-cast lens held on the holding head with respect to the optical axis with regard to the axis of the rotatable shaft and/or the axis position of a cylindrical or prismatic cut or with respect to conventional markings on the rough-cast lens by means of a detection device, converting the measured values into electrical signals by means of a converter before beginning the processing of the spectacle lens, inputting the signals into the control device of the installation and including these signals in the calculation of the predetermined contour of the spectacle lens, if appropriate in the axis position of a cylindrical or prismatic spectacle lens and/or in the decentration values during the CNC grinding of the spectacle lens, is described in DE 195 27 222 C2, in the name of the present applicant.

The installation which is used to carry out this known process has at least one grinding wheel, at least one rotatable shaft with a holding head for a rough-cast lens, at least one control device for the CNC grinding of the rough-cast lens in accordance with a predetermined contour of the spectacle lens, at least one input device, which is connected to the control device, for the predetermined contour of the spectacle lens, the optical values and/or if appropriate the axis position of a cylindrical or prismatic cut and/or the decentration values of the predetermined contour with regard to the optical axis of the rough-cast lens, and a detection device comprising a coaxial optical monitoring system for the optical values and/or if appropriate the axis position of a cylindrical or prismatic cut of the rough-cast lens and/or for conventional markings on the rough-cast lens, a converter for converting the recorded optical values, if appropriate the axis position and/or the conventional markings into electrical signals, the control device for CNC grinding of the rough-cast lens being connected to the converter, the shaft being designed as a hollow shaft and the holding head being of annular design, the detection device being arranged coaxially with respect to the holding shaft in order to detect the position of the rough-cast lens held on the hollow shaft of the holding head with respect to the axis of the hollow shaft, and the control device only being used to grind the rough-cast lens once the values recorded by the detection device have been taken into account.

The installation which operates in accordance with the abovementioned process does not require orientation of the rough-cast lens if it is fitted with its optical axis within permissible deviations on the holding head of the hollow shaft, since these deviations are captured by the optical monitoring system, are passed via the converter to the CNC control unit for the peripheral grinding of the rough-cast lens, where they are converted into corresponding correction values during grinding. In addition, the optical values and/or if appropriate the axis position of a cylindrical or prismatic cut of the rough-cast lens held on the holding head and/or for conventional markings on the rough-cast lens held by the holding head are taken into account in the CNC control unit for grinding the rough-cast lens, without the rough-cast lens having to be oriented in any way with respect to these values. The detection device may comprise a vertex refractionometer or a similar appliance, which can be used to record the optical values and, if appropriate, the axis position of a cylindrical or prismatic cut of the rough-cast lens held by the holding head. The detection device may also comprise an optical or opto-electronic monitoring system, which can be used to detect conventional markings provided by dots, crosses or the like on the rough-cast lens.

During the machining of the optical surfaces and/or of the edge of spectacle lenses, in particular during the high-performance machining which is becoming increasingly important, and in particular for spectacle lenses which are only held on one side on the holder, the forces which occur during machining can cause displacements of the spectacle lens. These displacements may lead to the rough-cast lens becoming offset with respect to the axis of rotation and!or being rotated, i.e. the angular position of the rough-cast lens changing with respect to the holder. If this displacement is not noticed, the finished spectacle lens is unusable, since either its optical values do not correspond to the required or input values or the decentration does not correspond to the input values. It may also arise that the axial position of a cylindrical or prismatic cut, the position of a near portion or the angular position of the progression channel of a continuous vision lens do not correspond to the input values.

SUMMARY OF THE INVENTION

The invention is based on the problem of controlling the machining of spectacle lenses in such a way that unusable spectacle lenses caused by a displacement of the rough-cast lens on the holder of the spectacle lens-machining machine are substantially avoided.

Working on the basis of this problem, the invention comprises a process for machining spectacle lenses by means of a CNC spectacle lens-machining machine of the type described in the introduction, in which the position of the rough-cast lens on the holder is continuously or cyclically checked during the machining by means of a sensor, and any recorded displacement of the rough-cast lens on the holder is continuously or cyclically incorporated in the spectacle lens-machining values.

This process according to the invention can, if suitably adapted, be carried out, for example, using the installation in accordance with foreign patent document DE 195 27 222 C2.

The invention is based on the problem of controlling the machining of spectacle lenses in such a way that unusable spectacle lenses caused by a displacement of the rough-cast lens on the holder of the spectacle lens-machining machine are substantially avoided.

Working on the basis of this problem, the invention proposes a process for machining spectacle lenses by means of a CNC spectacle lens-machining machine of the type described in the introduction, in which the position of the rough-cast lens on the holder is continuously or cyclically checked during the machining by means of a sensor, and any recorded displacement of the rough-cast lens on the holder is continuously or cyclically incorporated in the spectacle lens-machining values.

This process according to the invention can, if suitably adapted, be carried out, for example, using the installation in accordance with DE 195 27 222 C2.

On account of the process according to the invention, the production of scrap during the machining of the optical surfaces and/or the edge of the rough-cast lens is almost completely avoided, since the values recorded by the sensor in connection with any displacement which may have occurred are incorporated in the machining of the rough-cast lens.

Preferably, the recorded values of any displacement of the rough-cast lens which may have occurred on the holder are continuously or cyclically compared by calculation with a maximum permissible value for the displacement, so that the machining of the rough-cast lens is interrupted only if the maximum permissible value of the displacement is exceeded.

Since the recording of a displacement of the rough-cast lens on the holder is an indication that the holding force of the rough-cast lens on the holder is too low for the desired machining force and/or machining rate, according to a further advantageous configuration of the process, it is possible to provide that, after a displacement which does not exceed the maximum permissible value has been recorded, the machining force and/or the machining speed are reduced.

In the case of the edge-machining of a rough-cast lens, the optical values of the rough-cast lens, the decentration values and the angular position of any cylindrical or prismatic cut which may be present and/or of the progression channel of a continuous vision lens are fixed with respect to the axis of rotation, so that in this case, these values are checked with respect to the axis of rotation, and any deviations which occur are taken into account in the calculations.

Working on the basis of the abovementioned problem, the invention also proposes a process for the edge-machining of spectacle lenses by means of a CNC spectacle lens edge-machining machine, in which the rough-cast lens, during the edge-machining, is held on an annular holder of a driven, hollow spectacle lens-holding shaft, a coaxial measurement shaft with a sucker or adhesive block is guided through the spectacle lens-holding shaft into the axis of rotation of the rough-cast lens in order to make contact and be carried along with it, and a sensor records only the angular position of the coaxial shaft and transmits this to the control unit of the spectacle lens edge-machining machine.

In this process, the drive of the spectacle lens-holding shaft and the rotation-angle recording of the rough-cast lens are separate from one another, i.e. the spectacle lens-holding shaft serves only to hold the spectacle lens for the edge-machining and to make it rotate slowly, while the sensor arranged on the measurement shaft is used to record the current angular position of the rough-cast lens, to transmit this position to the machine control unit, where it is used to move the assembly of grinding wheels in the X and Z directions. The edge-machining is therefore controlled only by the rotation of the measurement shaft, so that any rotation of the rough-cast lens on the spectacle lens-holding shaft which may occur as a result of the grinding pressure has no effect whatsoever on the edge-machining.

The spectacle lens edge-machining machine which is used to carry out this process, according to the invention, has a hollow spectacle lens-holding shaft with an annular holder for a rough-cast lens, and a measurement shaft which is guided coaxially through the spectacle lens-holding shaft. At the free end of the measurement shaft, an adhesive block or sucker for attaching the measurement shaft to the rough-cast lens in the axis of rotation of the rough-cast lens is arranged in the region of the holder on the spectacle lens-holding shaft. This measurement shaft interacts with a rotation-angle sensor which is connected to the machine control unit.

BRIEF DESCRIPTION OF THE DRAWINGS

The invention is explained in more detail below with reference to two exemplary embodiments illustrated in the drawing, in which.

DETAILED DESCRIPTION OF PREFERRED EMBODIMENTS

Figure 1:
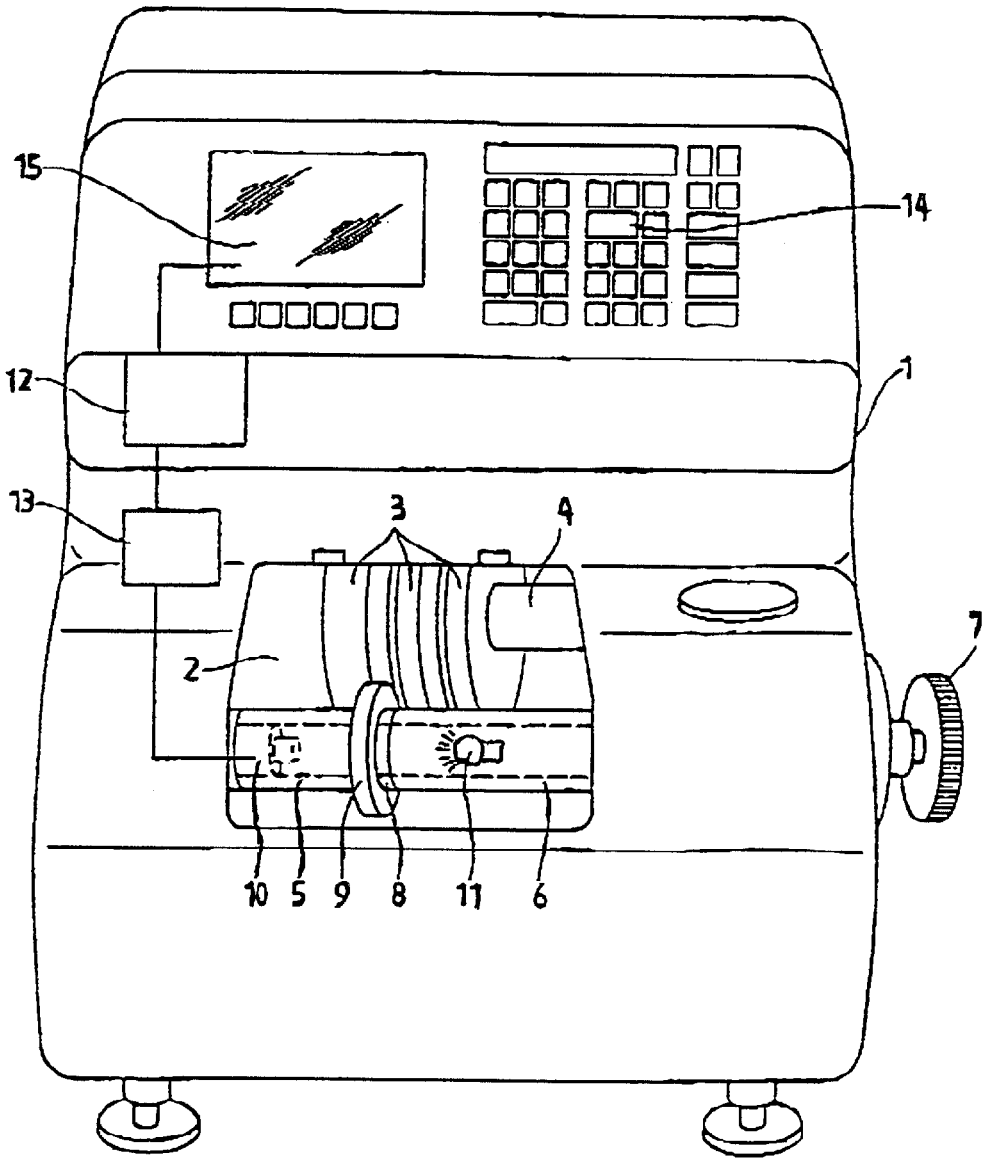
FIG. 1 shows a perspective view of a spectacle lens edge-grinding machine according to the invention.

A housing 1 of a CNC spectacle lens edge-grinding machine which is known per se is illustrated, in the grinding chamber 2 of which housing three grinding wheels 3 are arranged on a shaft 4. One of the grinding wheels, with a cylindrical surface, is used for the preliminary grinding of the contour of a spectacle lens, while the other two grinding wheels are used to grind various top bevels onto the form-ground spectacle lens.

Coaxial, rotatable, hollow half-shafts 5, 6, of which the half-shaft 6 is axially displaceable, are arranged parallel to the shaft 4 bearing the grinding wheels 3. At their ends, the half-shafts 5, 6 have holders 8 in the form of annular holding heads, between which a rough-cast lens 9 can be clamped. The clamping may take place automatically or by means of a handle 7.

The grinding of the peripheral edge in accordance with a predetermined shape of the spectacle lens takes place in a known CNC manner using a control device 12. The control device 12 is connected to an input device, in the form of a keyboard 14, by means of which the predetermined contour, the decentration values and, if provided, the axis position of a cylindrical or prismatic cut can be input.

Figure 3:
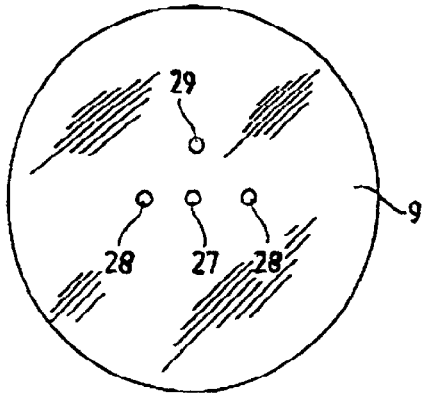

An illumination device 11 is arranged in the hollow half-shaft 6, while a detection device 10, in the form of a CCD camera, is arranged coaxially with respect to the illumination device, in the hollow half-shaft 5. This CCD camera is able to record conventional markings, e.g. a four-point marking 27, 28, 29 illustrated in FIG. 3, and to convert it into electrical signals. The point 27 of the four-point marking indicates the optical center of the rough-cast lens 9, while the axis position of a cylindrical or prismatic cut is given by the points 28, 29.

The signals generated by the detection device 10 pass into a converter 13, where they are converted into signals which can be used by the control device 12, so that the image of the rough-cast lens 9 recorded by the detection device 10 can be represented by the markings on a screen 15.

This screen 15 has a set of axes with a scale and a graduation, which are based on the axis of the hollow half-shafts 5, 6.

Before the grinding operation is initiated, the rough-cast lens 9 is fitted between the holders 8 and is held with a reduced pressure, so that if necessary the rough-cast lens 9 can be oriented by hand in such a way that the required position of the rough-cast lens 9 can be set on the screen 15, for example taking account of the required decentration values. The axis position of a cylindrical or prismatic cut can also be oriented on the basis of the graduation on the screen 15.

When the rough-cast lens 9 has been positioned in accordance with the predetermined values, the pressure of the half-shaft 6 is increased in a known way to a level required for grinding, and the CNC form-grinding can take place automatically.

The positioning of the rough-cast lens 9 can be dispensed with if the values which have been recorded by the detection device 10 are input into the control device 12 via the converter 13, where they are taken into account by calculation during the CNC grinding of the spectacle lens. This procedure can also be combined with the manual positioning if the manual positioning takes place approximately by observing the screen 15, and any deviations which are still present are then taken into account by calculation.

Figure 2:
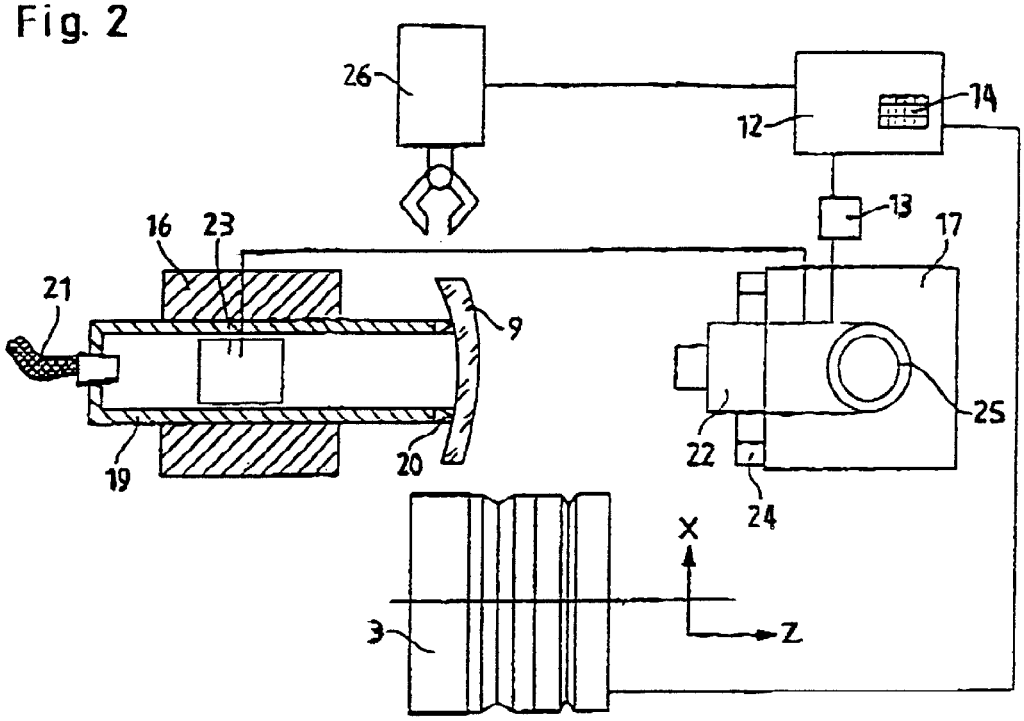
FIG. 2 shows a diagrammatic plan view, partially in section, of a spectacle lens edge-grinding machine in accordance with a second embodiment, FIG. 3 diagrammatically depicts a spectacle lens blank with a four-point marking.

In the embodiment illustrated in FIG. 2, there is only one hollow shaft 19 with a holder 20 in the form of an annular holding head, on which the rough-cast lens 9 can be held securely by means of a vacuum. For this purpose, a vacuum connection 21 is provided on the hollow shaft. The hollow shaft 19 is held rotatably on a bearing block 16 fixed to the housing, while the grinding wheels 3 can be adjusted in the X direction and the Z direction by means of a CNC control device 12, in a manner which is not illustrated.

A detection device 22, in the form of a vertex refractionometer, which interacts with an auxiliary system 23 arranged in the hollow shaft 19, is arranged on a support 17, which is fixed to the housing, coaxially with respect to the hollow shaft 19. A test mark connected to the auxiliary system 23 can be seen on a dioptric scale in an eyepiece 25. This detection device 22 can be connected to the control device 12 via a converter 13 in the manner which has been outlined above, allowing both orientation of the rough-cast lens 9 by observation in the eyepiece 28 and calculation which takes account of the recorded values for the CNC grinding of the rough-cast lens 9.

In this embodiment, there is a handling appliance 26, which picks up a rough-cast lens 9 in a manner which is not specifically illustrated and places it on the annular holding head 20. This handling appliance 26 can be of relatively simple design if it is used only to fit a rough-cast lens 9 to the holder 20 with its geometric axis coaxial with respect to the axis of the half-shaft 19. Any inaccuracies during positioning of the rough-cast lens 9 and the axis position of a cylindrical or prismatic cut which has been recorded by the vertex refractionometer 22 are then passed to the control device 12 via the converter and are taken into account by calculation during the form-grinding of the spectacle lens.

It is also possible to provide a CNC control unit for the handling appliance 26, which enables the rough-cast lens 9 to be fitted in an accurate position to the holder 20; in this case too, the vertex refractionometer 22 which is arranged coaxially with respect to the hollow shaft 19 serves to control the accurate positioning of the spectacle lens blank by means of the handling appliance 26 via the converter 13 and the control device 12.

The entire operation can be observed through the eyepiece 24 or on a screen or a ground glass disk.

Naturally, in the embodiment shown in FIG. 2, it is also possible to use a CCD camera 10 instead of a vertex refractionometer 22. In this case, it is advantageous for an annular illumination device 24 to be arranged on the support 17 or for the auxiliary system 23 to be designed as an illumination device.

This spectacle lens-machining machine illustrated in FIG. 2, on account of the one-sided clamping of the rough-cast lens 9, is also suitable for carrying out the machining of an optical surface.

During the machining of the optical surface and/or the edge of the rough-cast lens 9 in accordance with predetermined optical and/or shape-related values, the position of the rough-cast lens 9 on the holder 8 or 20 is checked continuously or cyclically by means of the vertex refractionometer 22 or the CCD camera 10 or another equivalent device, and any displacement of the rough-cast lens 9 on the holder 8 or 20 which may be recorded during the machining is continuously or cyclically included in the calculations of the values used for spectacle lens machining.

If the recorded values of any displacement of the rough-cast lens 9 which may have occurred on the holder 8 or 20, which are continuously or cyclically compared, by calculation, with a maximum permissible value for the displacement, exceed this maximum permissible value for the displacement, the machining of the rough-cast lens 9 is interrupted.

If a displacement which does not exceed the maximum permissible value is recorded, it is possible to eliminate the risk of further displacements during the machining by reducing the machining force and/or the machining speed. When machining the edge of spectacle lenses, this can be achieved by reducing the pressure exerted by the grinding wheels 3 on the rough-cast lens 9 or reducing the rotational speed of the spectacle lens-holding shaft 5, 6 or 19.

In the particular case of the edge-machining of a rough-cast lens 9, as illustrated in FIGS. 1 and 2, the position of the optical center with respect to the axis of rotation of the spectacle lens-holding shaft 5, 6 or 19 and, if appropriate, the angular position of a cylindrical or prismatic cut and/or of the progression channel of a continuous vision lens with respect to this axis of rotation are checked and, if appropriate, taken into account by calculation in the manner described.

The essential difference between the process according to the invention and known processes for grinding the optical surfaces and/or the peripheral edge of spectacle lenses consists in the fact that the rough-cast lens 9, possibly without previously having been provided with a block or sucker, is fitted to a holder in the form of the holder 8 or 20, is checked by means of the detection device in the form of the vertex refractionometer 22 or the CCD camera 10 with regard to the optical values and, if appropriate, axis position of a cylindrical or prismatic cut and/or conventional markings on the spectacle lens blank held by the holding head, and if appropriate is positioned, and the signals obtained by means of the vertex refractionometer or the CCD camera are used for correction, by calculation, of the CNC grinding of the peripheral edge both even before the machining has started and also during the machining, by continuously or cyclically checking the position of the rough-cast lens 9 on the holder 8 or 10 during the machining. The process according to the invention can also be used in an installation for machining the optical surfaces with the lens held on one side.

Figure 4:
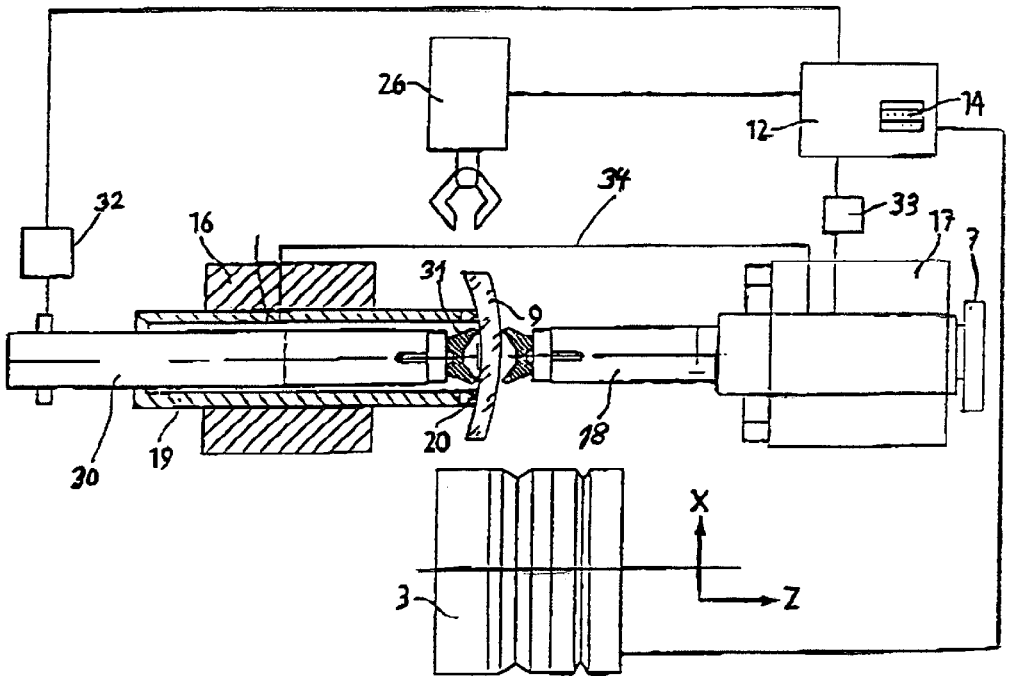
FIG. 4 shows a diagrammatic plan view, partially in section, of a spectacle lens edge-grinding machine in accordance with a third embodiment.

In the embodiment shown in FIG. 4, the rough-cast lens is held by means of a half-shaft, which is designed as a hollow shaft 19, with annular holder 20, and a half-shaft 18 which is coaxial with respect to the half-shaft 19 and can be displaced in the axial direction. The half-shaft 18 can be displaced in the axial direction, as described with respect to FIG. 1, either by means of the handle 7 or by means of a suitable drive, controlled by the control device 12, in order for the rough-cast lens 9 to be inserted.

The half-shafts 18, 19 are driven synchronously by means of a drive 33. A synchronizing connection 34 is diagrammatically illustrated. This can act mechanically or electrically, in known way.

A measurement shaft 30, which is axially displaceable and can be rotated with respect to the half-shaft 19, is arranged coaxially in the hollow shaft 19. An adhesive block or sucker 31 is arranged at the free end, facing the rough-cast lens 9, of the measurement shaft 30, and this block or sucker can be pressed onto the rough-cast lens 9, so as to adhere to it, by axial displacement of the measurement shaft 30. The rough-cast lens 9 and therefore also the measurement shaft 30 are carried along by the rotation of the half-shafts 18, 19 by means of the drive 33. The particular angular position of the rough-cast lens 9 is recorded by a rotation angle sensor 32, which is connected to the measurement shaft, and is transmitted to the control device 12. The infeed of the grinding-wheel assembly 3 in the X and Z directions is controlled by the control device 12 as a function of the angular position of the rough-cast lens 9 recorded by the rotation angle sensor 32.

Since the recording of the rotation angle of the rough-cast lens 9 takes place only by means of the measurement shaft 30 and the rotation angle sensor 32, completely independently of the rotary drive of the rough-cast lens 9 produced by the half-shafts 18, 19, any rotation of the rough-cast lens 9 between the half-shafts 18, 19 which occurs as a result of the grinding pressure has no effect whatsoever on the form-machining of the rough-cast lens 9, since this is controlled by the measurement shaft 30, the rotation angle sensor 32 and the control device 12.

If the adhesive block or sucker 31 is arranged in such a way with respect to the annular holder 20 that only as a result of the rough-cast lens 9 being placed onto the holder 20 does sufficient securing of the adhesive block or sucker 31 to the rough-cast lens 9 also occur at the same time, there is no need for the measurement shaft 30 to be axially displaceable; it then only needs to be able to rotate freely with respect to the hollow shaft 19.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A process to machine spectacle lenses using a spectacle lens-machining machine, the process comprising the steps of:

positioning a rough-cast lens on a holder of the spectacle lens-machining machine, the rough-cast lens having an optical surface and an edge;

machining at least one of the optical surface and the edge of the rough-cast lens in accordance with spectacle lens-machining values stored in a control device, the machining including a machining process selected from the group consisting of edge machining, grinding, prismatic machining, prismatic cutting, peripheral edge grinding, and polishing, the spectacle lens-machining values being determined in accordance with at least one of predetermined optical values and shape-related values of the rough-cast lens;

checking a position of the rough-cast lens on the holder during the machining of the rough-cast lens to determine whether the rough-cast lens displaces on the holder, the checking being performed using a sensor;

determining a displacement value of the rough-cast lens if the checking step determines that the rough-cast lens displaces on the holder; and updating the spectacle lens-machining values stored in the control device in accordance with the displacement value of the rough-cast lens during the machining of the rough-cast lens.

2. The process of claim 1, further comprising the steps of:

comparing the displacement value of the rough-cast lens to a maximum permissible displacement value; and interrupting the machining of the rough-cast lens if the displacement value of the rough-cast lens exceeds the maximum permissible displacement value.

3. The process of claim 1, further comprising the step of:

reducing at least one of a machining force and a machining speed if the displacement value of the rough-cast lens is detected when the position of the rough-cast lens on the holder is checked.

4. The process of claim 1, wherein the rough-cast lens has an optical center and an axis of rotation, the process further comprising the steps of:

determining a position of the optical center with respect to the axis of rotation of the rough-cast lens; and updating the spectacle lens-machining values in accordance with the determined position.

5. The process of claim 4, wherein the rough-cast lens is a continuous vision lens having a progression channel and at least one of a cylindrical and prismatic cut, the process further comprising the steps of:

determining an angular position of the progression channel and at least one of the cylindrical and prismatic cut with respect to the axis of rotation of the rough-cast lens; and updating the spectacle lens-machining values in accordance with the determined angular position.

6. The process of claim 1, wherein the holder is annular and includes a hollow spectacle lens-holding shaft, a measurement shaft being arranged within the hollow spectacle lens-holding shaft coaxially with the axis of rotation of the rough-cast lens, the measurement shaft having at least one of a vacuum arrangement and an adhesive to position the rough-cast lens on the holder, the process further comprising the steps of:

measuring an angular position of the measurement shaft; and updating the spectacle lens-machining values in accordance with the measured angular position of the measurement shaft.

7. The process of claim 6, wherein the angular position of the measurement shaft is measured using the sensor.

8. The process of claim 6, wherein the angular position of the measurement shaft is measured using a second sensor.

9. The process of claim 1, wherein the checking and updating steps are performed continuously.

10. The process of claim 1, wherein the checking and updating steps are performed cyclically.

11. The process of claim 1, further comprising the step of:

applying a grinding force to the rough-cast lens to grind the rough-cast lens.

12. The process of claim 1, further comprising the step of:

adjusting a holding force applied to the rough-cast lens while machining the rough-cast lens.

* * * * *